US010161580B2

(12) United States Patent
Mularski

(10) Patent No.: US 10,161,580 B2
(45) Date of Patent: Dec. 25, 2018

(54) ADJUSTABLE RECESSED LIGHTING ASSEMBLY

(71) Applicant: Pathway Lighting Products Inc., Old Saybrook, CT (US)

(72) Inventor: Jeremy James Mularski, Guilford, CT (US)

(73) Assignee: Pathway Lighting Products, Inc., Old Saybrook, CT (US)

( * ) Notice: Subject to any disclaimer, the term of this patent is extended or adjusted under 35 U.S.C. 154(b) by 0 days.

(21) Appl. No.: 15/593,971

(22) Filed: May 12, 2017

(65) Prior Publication Data

US 2018/0328554 A1 Nov. 15, 2018

(51) Int. Cl.

| | |
|---|---|
| ***F21S 8/02*** | (2006.01) |
| ***F21V 17/02*** | (2006.01) |
| ***F21V 21/14*** | (2006.01) |
| ***F21V 23/00*** | (2015.01) |
| ***F21V 29/80*** | (2015.01) |
| *F21Y 115/10* | (2016.01) |

(52) U.S. Cl.

CPC ..... *F21S 8/026* (2013.01); *F21V 17/02* (2013.01); *F21V 21/14* (2013.01); *F21V 23/001* (2013.01); *F21V 29/80* (2015.01); *F21Y 2115/10* (2016.08)

(58) Field of Classification Search

CPC ..... F21S 8/026; F21S 8/028; F21V 21/14; F21V 21/36; F21V 21/30; F21V 21/28; F21V 17/02

See application file for complete search history.

(56) References Cited

U.S. PATENT DOCUMENTS

| | | | | |
|---|---|---|---|---|
| 3,313,931 | A | 4/1967 | Clugman | |
| 3,974,371 | A | 8/1976 | Miles, Jr. | |
| 4,232,361 | A * | 11/1980 | Kelsall | F21S 8/026 362/269 |
| 4,306,279 | A | 12/1981 | Cohen | |
| 5,758,959 | A * | 6/1998 | Sieczkowski | F21S 8/026 362/148 |
| 6,004,011 | A | 12/1999 | Sieczkowski | |
| 7,234,674 | B2 | 6/2007 | Rippel et al. | |
| 7,530,717 | B2 | 5/2009 | Magisano et al. | |
| 7,874,709 | B1 | 1/2011 | Beadle | |
| 8,002,425 | B2 | 8/2011 | Russo et al. | |

(Continued)

FOREIGN PATENT DOCUMENTS

GB 2519430 A 4/2015

*Primary Examiner* — William N Harris

(74) *Attorney, Agent, or Firm* — Alix, Yale & Ristas, LLP

(57) ABSTRACT

An integrated recessed lighting assembly with an outer frame and inner sleeve with an electronics unit fixed to the outer frame. The frame is fixable to a building member with a portion within the recess opening and the electronics unit concealed behind the building member. Brackets are fixed to the frame and provide multi-directional slots for maintaining the inner sleeve via cooperative projections. The inner sleeve is slidable along a portion of the slots from a lower position with its terminal edge distal to the frame distal edge to a raised position with its terminal edge proximal to the frame proximal edge and building member, and then slidable along another portion of the slots to an offset position at least partially concealed by the building member to open an access opening through the frame to the electronics unit.

20 Claims, 8 Drawing Sheets

(56) References Cited

U.S. PATENT DOCUMENTS

| | | | | |
|---|---|---|---|---|
| 8,297,804 | B2 | 10/2012 | Buse | |
| 8,376,594 | B2 | 2/2013 | Park et al. | |
| 8,820,985 | B1 * | 9/2014 | Tam | F21V 21/14 362/249.1 |
| 8,944,648 | B1 | 2/2015 | Dupre | |
| 2016/0186967 | A1 | 6/2016 | Mathews et al. | |
| 2016/0320028 | A1 * | 11/2016 | Paulsel | F21S 8/026 |
| 2017/0184285 | A1 * | 6/2017 | Visser | F21V 21/047 |
| 2017/0227201 | A1 * | 8/2017 | Fujisawa | F21V 21/30 |

* cited by examiner

ADJUSTABLE RECESSED LIGHTING ASSEMBLY

BACKGROUND OF THE DISCLOSURE

The present disclosure relates to lighting assemblies, and more particularly, to adjustable light-emitting diode (LED) recessed lighting assemblies with integrated electronics.

Recessed lighting assemblies or fixtures are designed to be recessed into a building member, which building member is most commonly a ceiling. Often, installation of a recessed lighting assembly includes installing and attaching many different components on the inner (upper) area or surface of the building member with the lighting components housed within a portion of the assembly and positioned within a hole in the building member. In such assemblies, typically, a support or frame is attached to the building structure above the ceiling along with additional operational components such as wiring and an electronics unit including a driver circuit for activating and operating the lighting components. Often, these components are all separate units pieced together by the installer. An additional complication often arises when installing lighting fixtures in this manner in that the installer must painstakingly ensure that all measurements and positioning of the different components complies with relevant building codes.

Further, it is often desirable to access inner or upper components of an installed lighting assembly, for maintenance of the electronics or adjustment of any elements or similar. For example, an electronics unit may house a driver circuit or branch circuit for operating the lighting components within the assembly. In recessed lighting assemblies, electronics units like these are commonly hidden behind the building member within which the lighting components are recessed. In most known recessed lighting assemblies, gaining access to the electronics unit is often burdensome, time consuming and costly in that it requires accessing the inner components from above the ceiling, cutting into the ceiling or other building structure and/or disassembling the lighting fixture or components or other parts of the assembly.

Adjustable systems and assemblies have been developed with features to assist in accessing different components. For example, some external lighting assemblies include a pivoting mechanism that allows a user to shift the lighting components downward to assist in accessing rear components. However, even in such systems, the lighting components remain positioned between a user and the electronics or require lighting components to hang into the interior of a room (below the lower surface of the ceiling), and do not provide completely open access to the rear components.

Additionally, building members within which a recessed lighting assembly can be installed vary greatly in terms of materials and thickness. For example, different lighting assemblies or mounts would be required for installation into a 0.25 inch thick ceiling versus a 0.5 inch thick ceiling, and other ceilings of thicknesses up to approximately 2.5 inches. In years prior this required many different components and unique assemblies to accommodate different building materials and thicknesses.

SUMMARY

There is a need for an all-in-one recessed lighting assembly that solves the problems enumerated above in that it provides a standalone fully integrated assembly with depth/height adjustability that also allows movement of the front components out of the way to provide a completely open access opening for accessing the driver electronics from the opposite side of the ceiling (i.e., underneath) without the drawbacks enumerated above.

According to one disclosed embodiment, a lighting assembly has an outer frame with a lower edge and an upper edge. The upper edge is positionable on an inner portion of a building member and the frame is attachable to the building member. The frame defines an open inner cavity passing from the lower edge to the upper edge. An integrated electronics unit is fixed relative to the outer frame in a position above the upper edge. Opposite brackets each defines a multi-directional slot fixed relative to the frame on opposite sides of the frame such that the slots in the respective brackets are substantially aligned with one another. An inner sleeve holds at least one lighting component in operable communication with the electronics unit. The inner sleeve has a terminal edge and is positionable within the inner cavity. The inner sleeve includes a pair of opposite projections each extending away from the inner sleeve that are engagable within a slot in one of the opposite brackets. The position of the inner sleeve relative to the outer frame can be adjusted via movement of the projections along the slots from a lowered position with the inner sleeve within the inner cavity and the inner sleeve terminal edge below the lower edge of the outer frame to a raised position with the inner sleeve terminal edge above the upper edge of the outer frame. From the raised position, the sleeve is adjustable to an offset position with the inner sleeve at least partially above the building member, thereby providing open access to the electronics unit from the direction below the lower edge of the outer frame through an open inner cavity.

In another embodiment of the recessed lighting assembly, a frame has a substantially cylindrical lower portion extending to a distal edge and a flange extending outward from and substantially perpendicular to the cylindrical portion proximal to the distal edge. The cylindrical portion defines a central axis and an access opening from a bottom surface to a top surface of a planar building member. An electronics unit is fixed to the frame in a front position proximal to the flange. A first bracket is fixed to the frame and positioned proximal to the flange extending substantially perpendicular to the planar building member on one side of the cylindrical portion. The first bracket defines a first slot that extends in an axial direction and a rearward direction away from the electronics unit. A second bracket is fixed to the frame and positioned proximal to the flange extending substantially perpendicular to the planar building member on the opposite side of the cylindrical portion of the first bracket. The second bracket defines a second slot that extends in the axial direction and the rearward direction. An inner sleeve for holding at least one light-emitting diode (LED) component in operable communication with the electronics unit is sized for receipt within the substantially cylindrical lower portion of the frame. The inner sleeve is engaged with both of the first and second brackets and has a terminal edge. The inner sleeve is reciprocable along the first slot and second slot in the axial direction between a lowered position with the terminal edge distal to the distal edge of the frame and a raised position with the terminal edge proximal to the flange of the frame. When the inner sleeve is in the raised position, the sleeve is reciprocable between a forward position substantially aligned with the access opening blocking access to the electronics unit from the bottom surface of the building member to a rear position exposing at least a portion of the access opening allowing access to the electronics unit from the bottom surface of the building member.

BRIEF DESCRIPTION OF THE DRAWINGS

Aspects of the preferred embodiment will be described in reference to the Drawing, where like numerals reflect like elements.

DETAILED DESCRIPTION OF THE PREFERRED EMBODIMENT

Among the benefits and improvements disclosed herein, other objects and advantages of the disclosed embodiments will become apparent from the following wherein like numerals represent like parts throughout the several figures. Detailed embodiments of an adjustable recessed lighting assembly are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Figure 1:
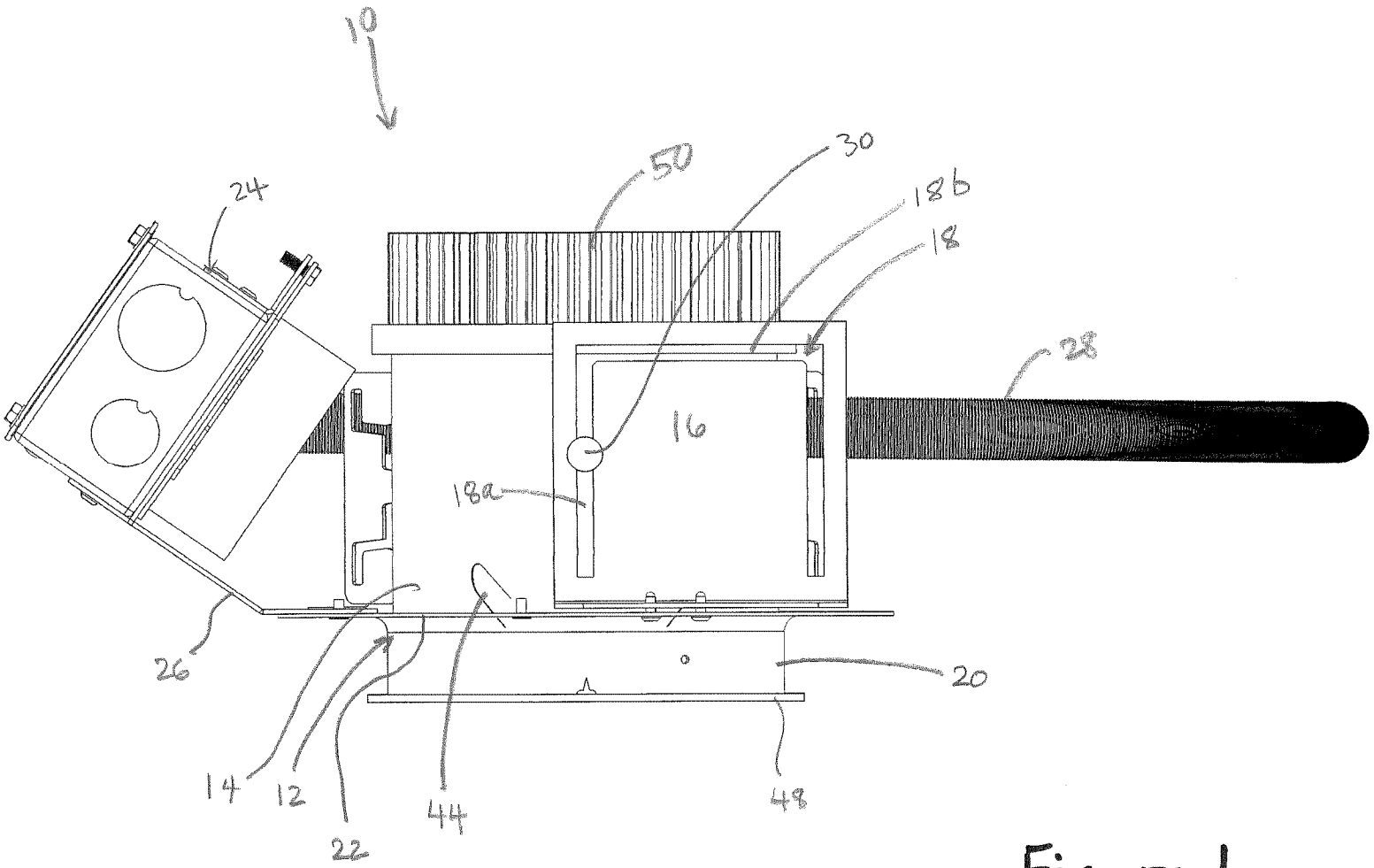
FIG. 1 is a side elevation view of the disclosed adjustable lighting assembly.

With reference initially to the side view of FIG. 1, disclosed is an adjustable recessed lighting assembly 10 generally comprising an outer frame 12 and an inner sleeve 14 secured within the frame 12 via a pair of side brackets 16 each defining a multi-directional slot 18. As shown, the frame 12 includes a cylindrical portion 20 and an annular flange 22 extending outward substantially perpendicular to the cylindrical portion. The frame 12 generally provides the structural stability for securely attaching the lighting assembly 10 within a ceiling recess. In the depicted preferred embodiment, the frame includes a plurality of outer brackets 34 for assisting the secure attachment within a ceiling 35.

Figure 4:
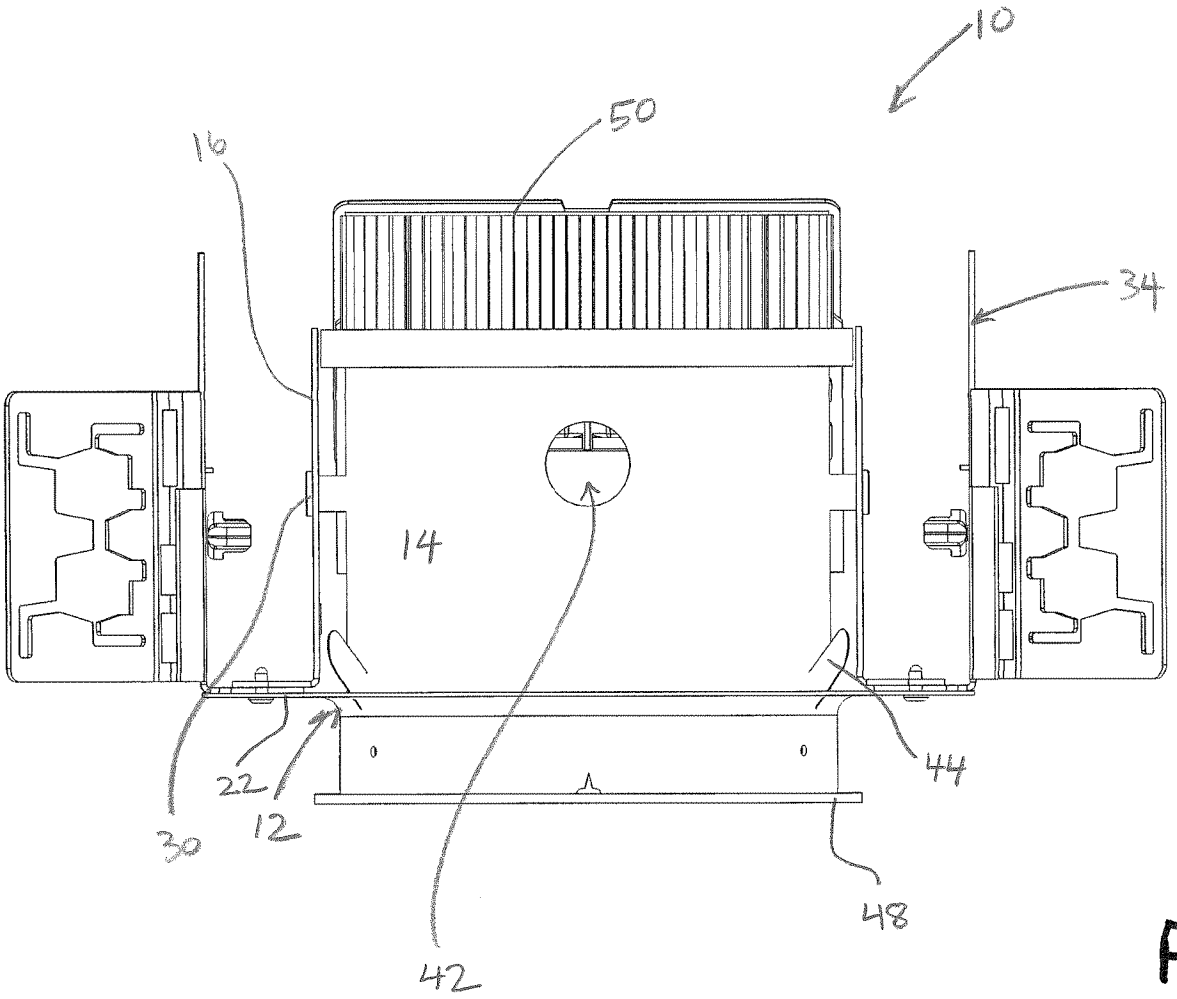
FIG. 4 is a rear elevation view of the disclosed lighting assembly with the wiring conduit removed for clarity.
Figure 5:
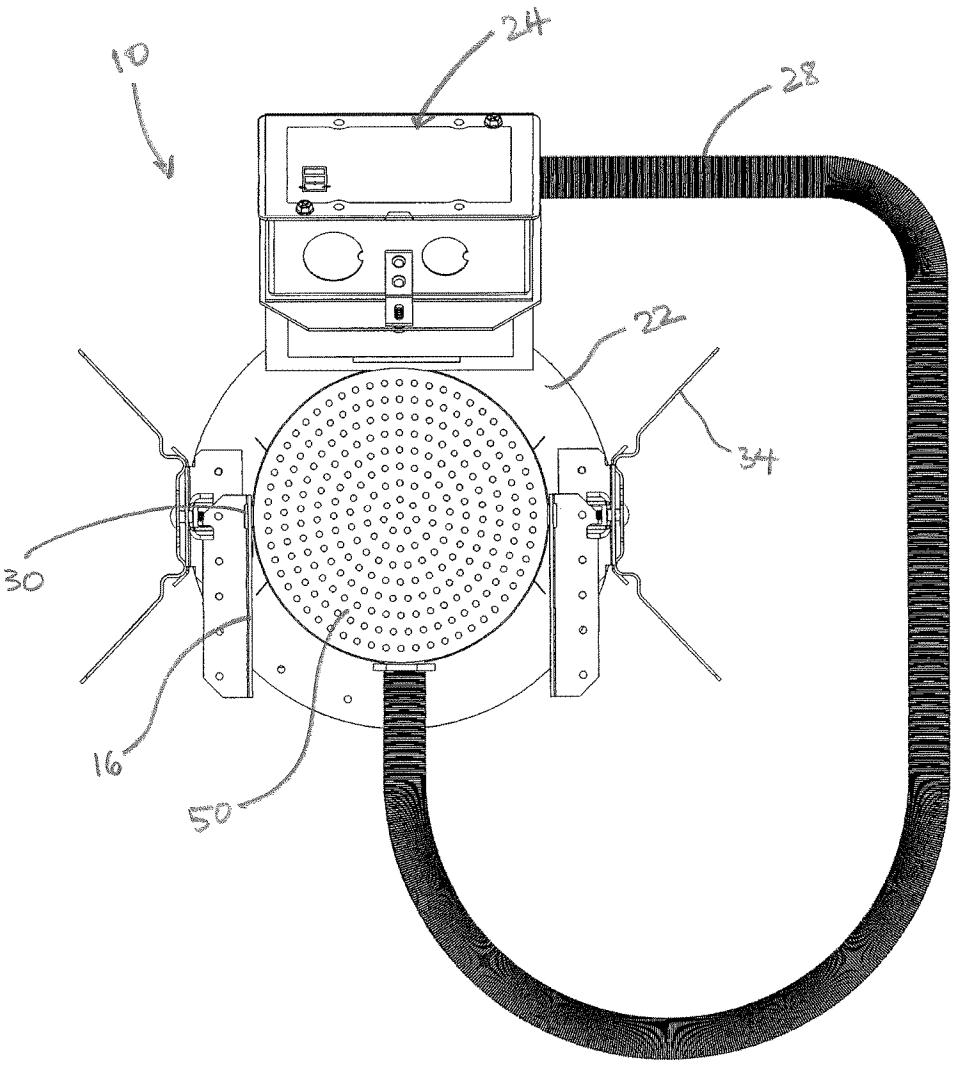
FIG. 5 is a top elevation view of the disclosed lighting assembly.

In this embodiment of the standalone assembly 10, an electronics unit 24 is securely attached to the frame 12 at a front position by way of a bent flange or bracket 26. Note that the oblique bend in the flange depicted in FIG. 1 is non-limiting, in that additional embodiments exist that include a flange with a substantially perpendicular bend or a flat base surface on which the electronics unit is mounted. Herein, the electronics unit 24 is used generally to describe a unit, which may be housed, partially housed or open, that includes a circuit or other electronic components for operating the lighting components within the lighting assembly, including without limitation, a driver circuit or branch circuit connections. A flexible conduit of wiring 28 operatively connects the electronics to lighting components contained within the inner sleeve 14. As shown in the depicted embodiment, the conduit 28 connects to the inner sleeve 14 via an opening 42 proximate the rear side to provide a clear and open pathway for wiring to the inner sleeve 14. The opening 42 can be seen most closely in FIG. 4, wherein the conduit 28 has been removed for clarity. The specific arrangement of the conduit 28 in relation to the electronics unit 24, frame 12 and inner sleeve 14 is non-limiting so long as the electronics unit 24 is operatively connected to operate the lighting components maintained within the sleeve 14 and the tubing and wiring permits multi-directional movement of the sleeve 14 relative to the frame 12 and electronics unit 24.

Figure 2:
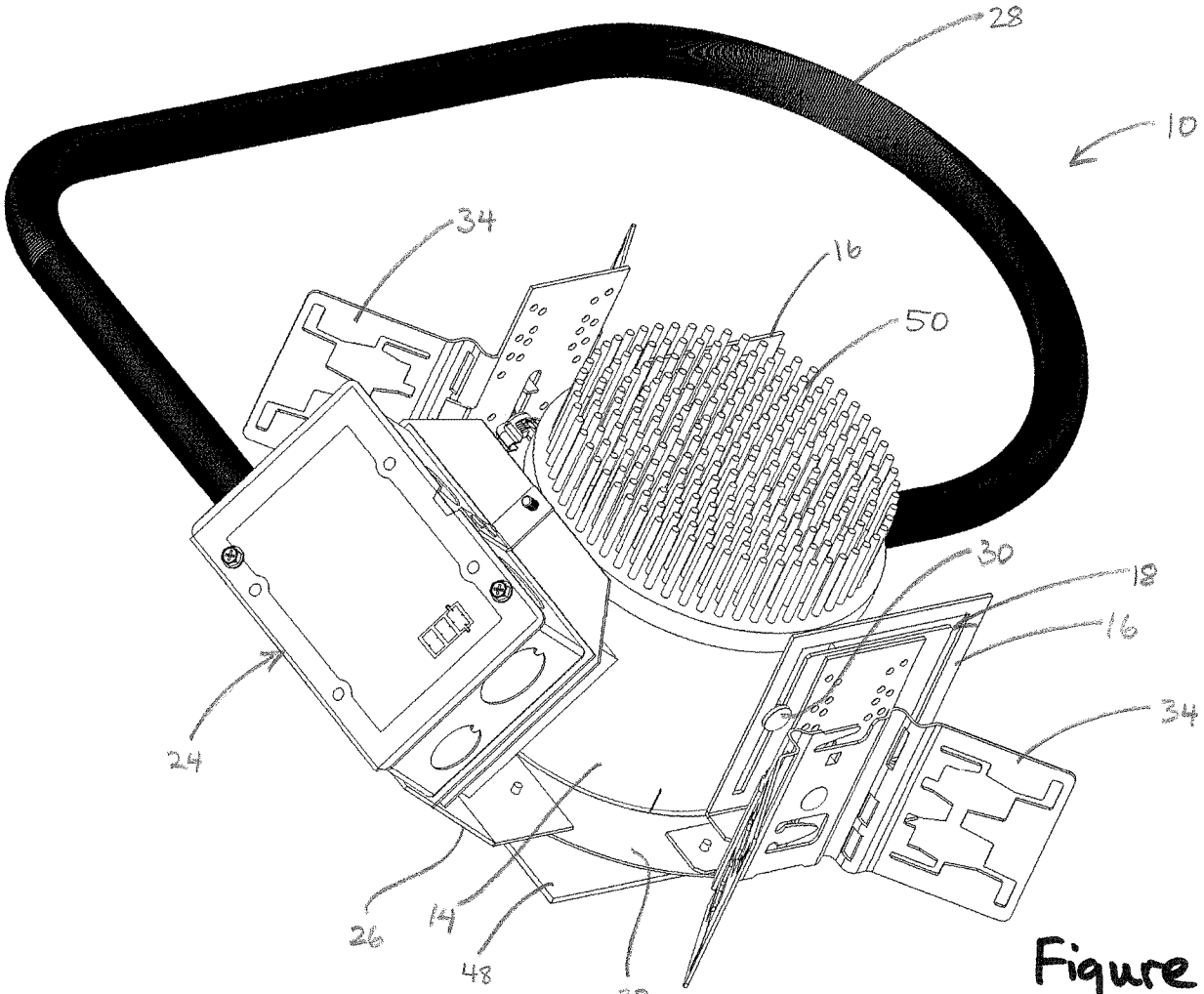
FIG. 2 is a top perspective view of the lighting assembly of FIG. 1.
Figure 3:
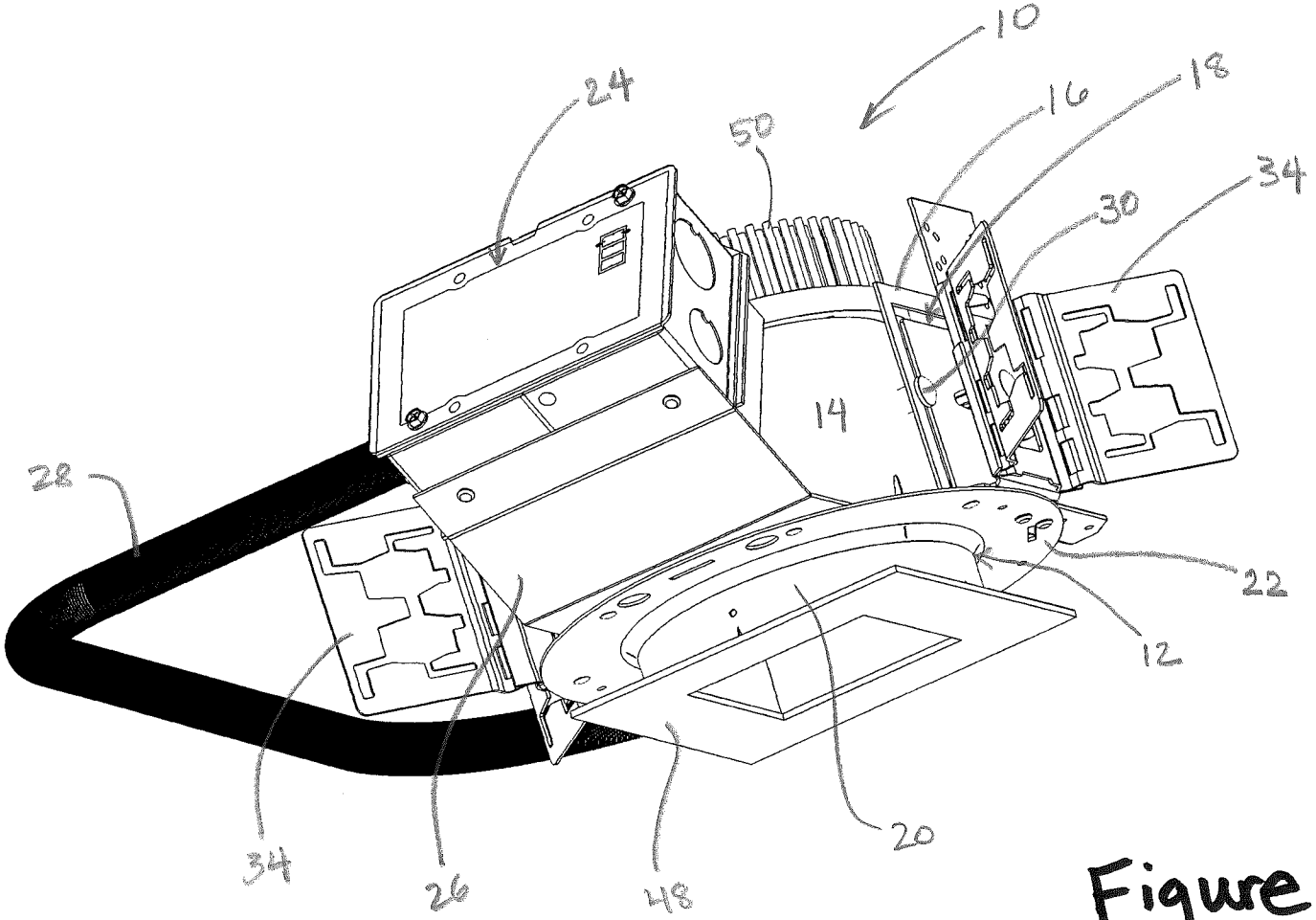
FIG. 3 is a bottom perspective view of the disclosed lighting assembly.

The inner sleeve 14 is sized and shaped to fit within the frame 24. In the depicted embodiment of the Figures, the sleeve 14 has a substantially cylindrical shape sized to be housed coaxial to the substantially cylindrical portion 20 of the frame 12 in a slidable relationship. Various fasteners, clamps or similar elements may be included to assist in maintaining the sleeve 14 and frame 12 as desired. As shown, the inner sleeve may include a plurality of tabs 44 for providing a frictional relationship to assist in maintaining the alignment of the sleeve and frame. The sleeve 14 houses lighting components, such as, for example light-emitting diode (LED) or similar units, reflectors or other light direction components, printed circuit boards (PCBs) and/or heat dissipation components. The lighting components are generally represented by reference character L in FIGS. 7 and 8A, although these particular depicted components and relationships are only exemplary, and thus nonlimiting. In this embodiment, the inner sleeve 14 also includes a heat sink 50 in an upper region for assisting in heat dissipation from the inner region of the sleeve. An embodiment of the heat sink 50 can be seen most clearly in the top perspective view of FIG. 2. As noted above, the lighting components are operatively connected to the electronics unit 24 through the flexible conduit 28 for activation and operation of the lights in the assembly 10.

Figure 6:
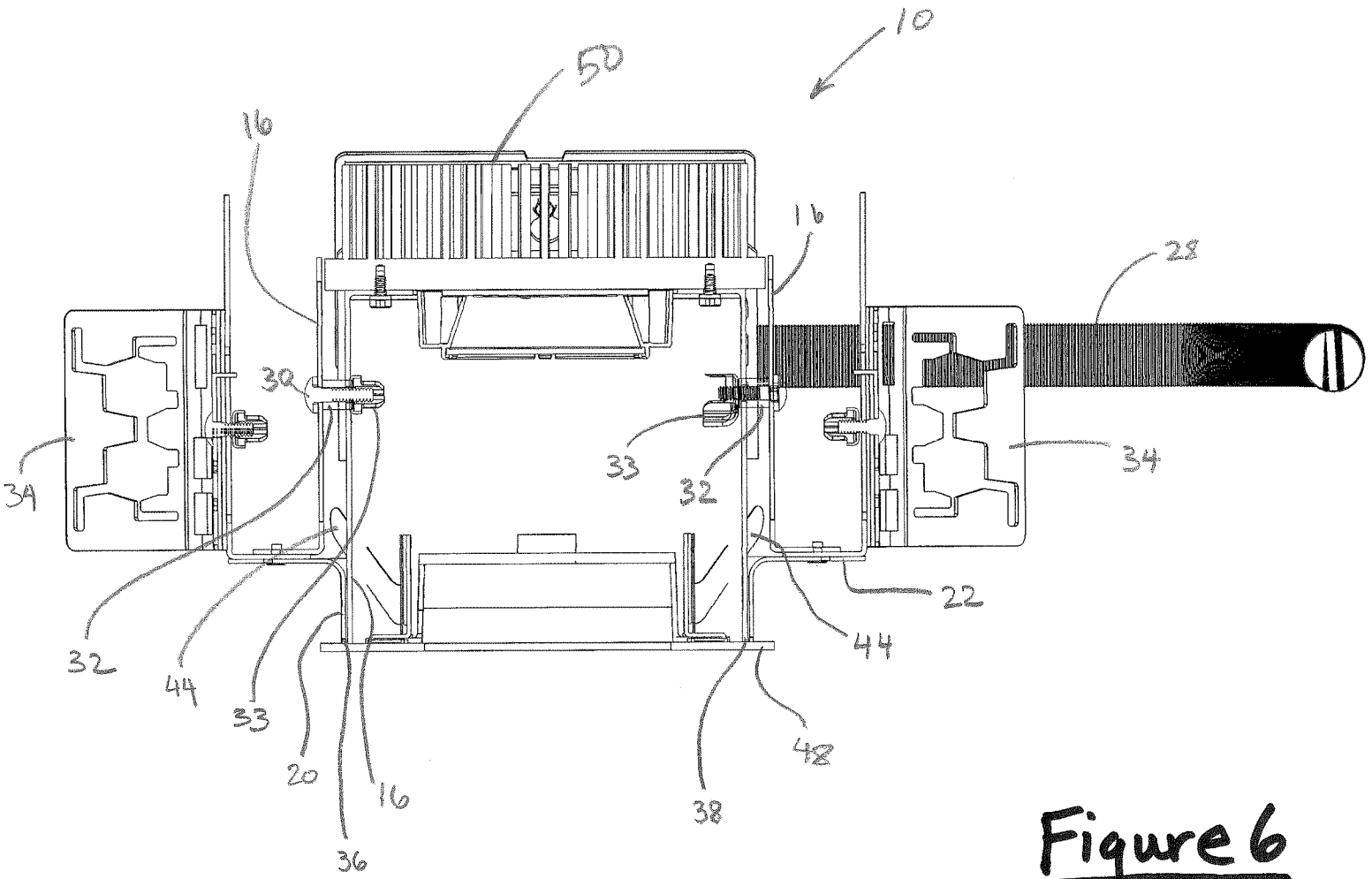
FIG. 6 is a cross-sectional view of the lighting assembly of FIG. 1.

As shown, the frame 12 includes a pair of inner side brackets 16 on opposite sides of the cylindrical portion 20. In the depicted embodiments, the brackets 16 are fixed on the annular flange 22 by a plurality of fasteners. This particular mechanism of attachment is nonlimiting in that the brackets may be attached at a different location or by a different means. Each bracket 16 defines a multi-directional slot 18 having at least an axial or vertical portion 18*a* and a lateral portion 18*b* extending in the direction away from the electronics unit 24. The particular depicted embodiment includes a slot 18 that has an inverted substantially U-shape. The U-shaped slot has been found to be particularly useful in manufacturing the assembly 10 in that the same bracket component can be used on both sides of the frame 14 instead of requiring two separate brackets with L-shaped slots that are mirror images of one another. The inner sleeve 14 includes a pair of pins or bolts 30 extending outwardly, each bolt 30 slidingly engaged within a slot 18. With reference to the cross sectional view of FIG. 6, each bolt 30 is threaded on at least a distal end and is passed through a cross sleeve 32 intermediate the bracket 16 and inner sleeve 14. The distal threading on each bolt 30 passes into the inner region defined by the sleeve 14 and a wing nut 33 is threaded on the end from the inside. A removable trim cap 48 is optionally fixed toward the terminal edge 38 of the inner sleeve 14. A trim cap 48 is primarily attached for aesthetic purposes, but it can also provide a soft stop mechanism to prevent the inner sleeve 14 from passing further upward into the frame 12 than desired. As shown, the trim cap 48 can take numerous shapes, including square and circular.

Figure 7:
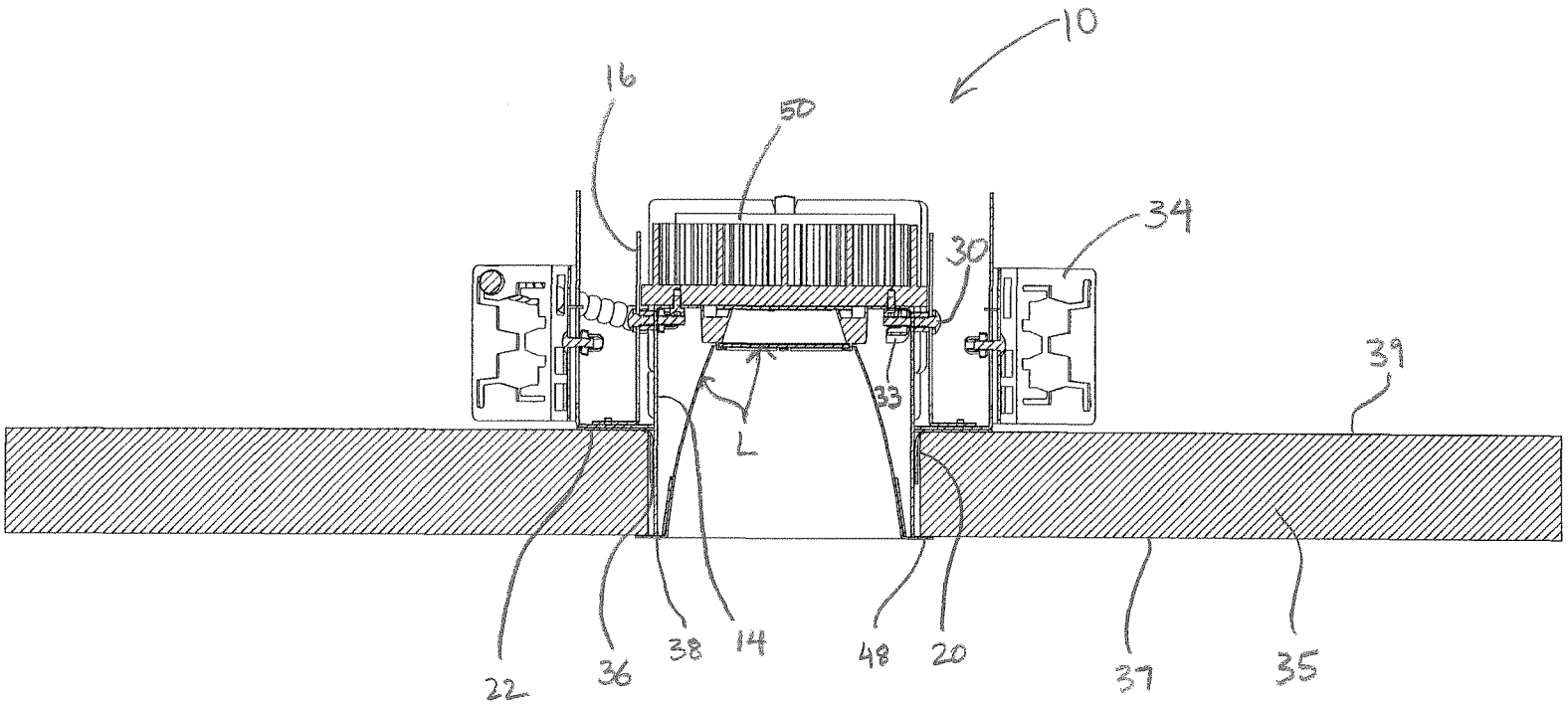
FIG. 7 is a cross-sectional view of an embodiment of the disclosed lighting assembly installed in a building member in an operating position.

With reference to the assembly installation shown in FIG. 7, typically an assembly 10 is installed in a recess within a ceiling 35 by inserting the cylindrical portion 20 of the frame into a hole in the ceiling with the inner sleeve 14 maintained within the frame 12. In such an installation, the annular flange 22 on the frame 12 provides a surface for abutting the top surface 39 of the ceiling. In the depicted embodiment, the frame 12 is fixed to the installation by way of the outside brackets 34 attached on opposite sides. The frame 12 can be fixed relative to the ceiling structure 35 and adjusted by any known methods of attaching, for example, fasteners, brackets and/or adhesives. The inner sleeve 14 is attached to frame 12 via the fasteners 30 engaged with the inner brackets 16 independent of the ceiling structure 35, allowing the described adjustability of the inner sleeve 14 (and lighting components housing within).

The assembly 10 is configured such that the distal edge 36 of the cylindrical portion of the frame 12 is positioned within the thickness of a typical ceiling structure 35 with the flange 22 abutting the upper surface 39 and the lower surface 37 of the ceiling distal to the distal edge 36. In the installed and working condition of the assembly 10, the inner sleeve is adjusted vertically along the vertical portion 18*a* of the slots 18 until the desired height relative to the ceiling structure 35 is reached. Typically the sleeve 14 is adjusted vertically until the terminal edge 38 is approximately at the position of the lower surface 37 of the ceiling with the trim cap 48 on the outside of the ceiling recess (see FIG. 7, for example). These elements and their relationships to one another allows the assembly 10 to be installed in ceiling structures of widely varying thicknesses instead of requiring a unique lighting assembly for different sized ceiling structures. For example, the same assembly can be installed in a recess in ceilings having a thicknesses of between approximately 0.25 inches to 2.5 inches, simply by reciprocating the inner sleeve 14 vertically within the frame 12 along the respective vertical portions 18*a* of the slots, and then tightening the inner nuts 33 on each side to fix the sleeve 14 in place along the brackets 16. The flexibility or malleability of the wiring conduit 28 assists in allowing the inner sleeve 14 to be positioned at many different locations relative to the electronics unit 24, while maintaining the operative connection of the electronics and the lighting components through the hole 42 in the inner sleeve 14.

Further to the vertical adjustability and versatility described above, the multi-directional slot 18 allows full unimpeded access to the electronics unit 24 from the bottom 37 of the ceiling structure 35. More specifically, if and when the electronics unit 24 in an installed assembly 10 requires maintenance, the inner sleeve 14 can be reciprocated upward along the vertical portion 18*a* until its terminal edge 38 rises above the upper plane defined by the top (inner) surface 39 of the ceiling member 35 (the fully raised position). Once in the fully raised position, the inner sleeve 14 can be reciprocated rearward over the ceiling member 35 with the bolts 30 traveling along the lateral portion 18*b* of the slot to yield an unobstructed access opening 40 to the electronics unit 24 from the bottom (outer) side of the ceiling member 18. Since the electronics unit 24 is fixed to a portion of the frame 12, the sleeve 14 is movable independent of the electronics unit.

Figure 8A:
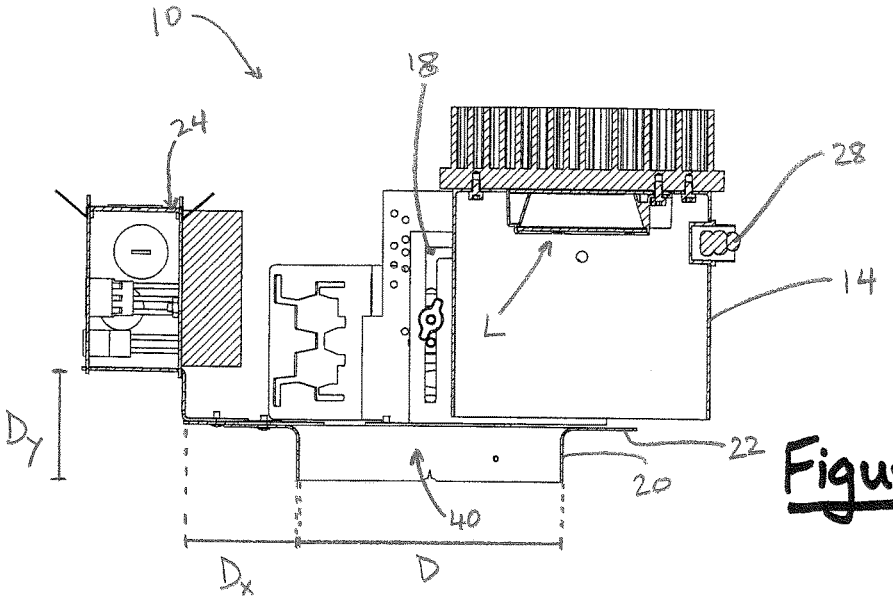
FIG. 8A is a partial cross-sectional view of the installed assembly of FIG. 8A in a rear position.
Figure 8B:
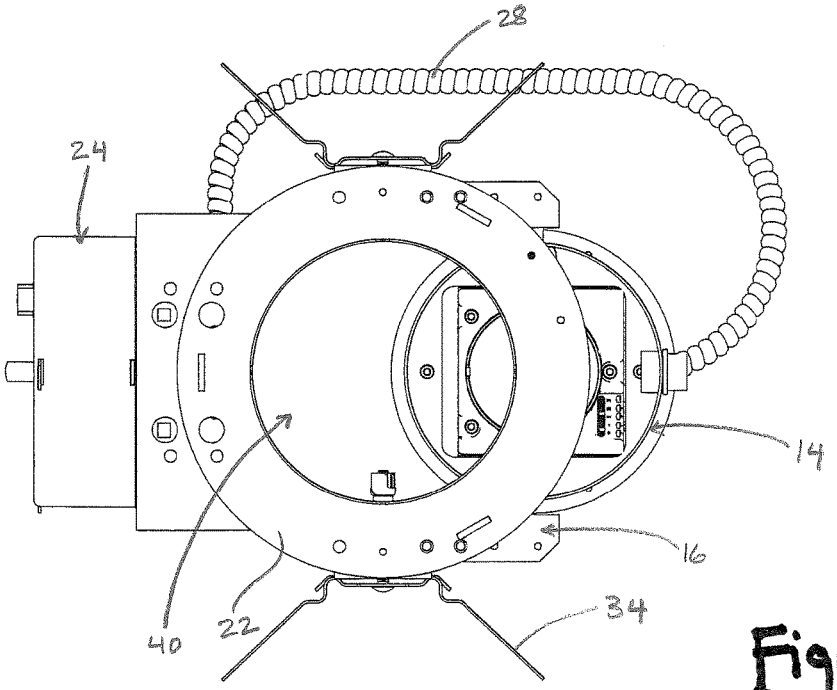
FIG. 8B is a bottom view of the assembly in the rear position shown in FIG. 8A.

Unlike known recessed lighting systems, the fully integrated recessed lighting assembly 10 includes notable elements, such as the frame 12, inner sleeve 14 with lighting components, electronics unit 24, wiring and wire conduit 28 in a standalone system. Thus, the electronics unit 24 can be freely and openly accessed at any time without requiring (a) disassembly or removal of the lighting assembly 10 from the ceiling recess, (b) removal of the assembly from the recess, (c) cutting into the ceiling or drywall, or (d) accessing from the top (inner) side of the ceiling. Of further note is that the exact manufacturing specifications of the assembly 10 can be altered in order to comply with all known regulations, for example, UL safety compliance code. With reference to FIG. 8A, in one embodiment, the access opening 40 has an inner diameter D, the distance from the closest edge of the access opening 40 to the nearest surface of the electronics unit 24 is identified as $D_x$, and the distance from the lower plane defined by the access opening 40 to the plane of the closest surface of the electronics unit 24 is identified as $D_y$. These reference measurements are commonly used in known building safety codes. Since the integrated assembly 10 is a single stand-alone unit, the measurements, such as D, $D_x$ and $D_y$ (or other distances that may form the basis for relevant building code) can be adjusted to comply with the relevant building codes straight "out of the box" without requiring measuring or any other altering at the installation site. In one exemplary embodiment, the diameter D of the access opening is represented by Formula I:

$$D \geq 75 + D_x + D_y \qquad \text{[Formula I]}$$

where D, $D_x$ and $D_y$ are all measured in millimeters (mm). In another embodiment, the assembly is designed with an access opening of at least approximately 150 mm.

The particular materials, sizes, comparative measurements and shapes of the elements described with respect to the disclosed preferred embodiments may vary without departing from the inventive concepts of the disclosed lighting assembly. For example, the preferred embodiments have been described with reference to a cylindrical inner sleeve 14 and cylindrical portion 20 of the frame. However, these shapes are nonlimiting in that embodiments exist with a sleeve and cooperative portion of the frame that take on a rectangular prismic or ovular shape. Further, it is not essential that the sleeve and portion of the frame take on the same shape as each other so long as the sleeve is adjustable along the multiple directions to provide an open access opening to the electronics unit as described herein. Similarly, while a particularly preferred embodiment includes a frame, sleeve and brackets formed from stainless steel, other rigid and strong materials may be substituted, such as polymeric materials or other metals, for example. Further, the diameter or other lateral extent of the access opening can within a typical range of approximately 2-8 inches, while the thickness of the building member within which the assembly can be installed (and that the sliding sleeve can accommodate) varies within a typical range of approximately 0.25 inches to 2.5 inches.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A lighting assembly comprising:

an outer frame having a lower edge and an upper edge, the upper edge being positionable on an inner portion of a building member, the outer frame being attachable to the building member and defining an open inner cavity passing from the lower edge to the upper edge;

an integrated electronics unit fixed relative to the outer frame in a position above the upper edge;

opposite brackets defining a multi-directional slot fixed relative to the frame on opposite sides of the frame such that the slots in the respective brackets are substantially aligned with one another;

an inner sleeve for holding at least one lighting component in operable communication with the electronics unit, the inner sleeve having a terminal edge and being positionable within the inner cavity and including a pair of opposite projections each extending away from the inner sleeve and engagable within a slot in one of the opposite brackets, wherein the position of the inner sleeve relative to the outer frame can be adjusted via movement of the projections along the slots from a lowered position with the inner sleeve within the inner cavity and the inner sleeve terminal edge below the lower edge of the outer frame to a raised position with the inner sleeve terminal edge above the upper edge of the outer frame, and from the raised position to an offset position with the inner sleeve at least partially above the building member, thereby providing open access to the electronics unit from the direction below the lower edge of the outer frame through an open inner cavity.

2. The lighting assembly of claim 1, wherein each of the opposite brackets has a slot with a substantially longitudinal portion and a lateral portion substantially perpendicular to the longitudinal portion.

3. The lighting assembly of claim 2, wherein each of the opposite brackets defines an inverted substantially L-shaped slot.

4. The lighting assembly of claim 2, wherein each of the opposite brackets defines an inverted substantially U-shaped slot.

5. The lighting assembly of claim 1, wherein the outer frame comprises an outwardly extending flange for abutting an upper surface of the building member.

6. The lighting assembly of claim 1, wherein the inner cavity of the outer frame and the inner sleeve have a portion with a substantially circular cross section that are positioned substantially coaxial to one another.

7. The lighting assembly of claim 1, wherein the position of the sleeve relative to the outer frame is fixable in numerous longitudinal positions intermediate the lowered position and the raised position.

8. The lighting assembly of claim 1, wherein the outer frame includes a substantially cylindrical portion from the lower edge to an outwardly extending annular flange.

9. The lighting assembly of claim 1, wherein the inner cavity has a diameter that is at least approximately 150 mm.

10. The lighting assembly of claim 1, wherein the electronics unit is positioned a perpendicular distance $D_x$ from a line perpendicular to the lower edge of the outer frame at a position that is closest to the electronics unit, and a perpendicular distance $D_y$ from a plane defined by the lower edge of the outer frame, and the outer frame has a diameter D that is no less than the sum of $75+D_x+D_y$ measured in millimeters.

11. The lighting assembly of claim 1, wherein the outer frame has a substantially rectangular prismic section leading to a substantially rectangular lower edge and the inner sleeve has a substantially rectangular prismic section leaving to a substantially rectangular terminal edge.

12. A lighting assembly comprising:

a frame having a substantially cylindrical lower portion extending to a distal edge and a flange extending outward from and substantially perpendicular to the cylindrical portion proximal to the distal edge, the cylindrical portion defining a central axis and an access opening from a bottom surface to a top surface of a planar building member;

an electronics unit fixed to the frame in a front position proximal to the flange;

a first bracket fixed to the frame positioned proximal to the flange and extending substantially perpendicular to the planar building member on one side of the cylindrical portion, the first bracket defining a first slot that extends in an axial direction and a rearward direction away from the electronics unit;

a second bracket fixed to the frame positioned proximal to the flange and extending substantially perpendicular to the planar building member on the opposite side of the cylindrical portion of the first bracket, the second bracket defining a second slot that extends in the axial direction and the rearward direction; and an inner sleeve for holding at least one light-emitting diode (LED) component in operable communication with the electronics unit, the inner sleeve being sized for receipt within the substantially cylindrical lower portion of the frame, the inner sleeve being engaged with both of the first and second brackets and having a terminal edge, wherein the inner sleeve is reciprocable along the first slot and second slot in the axial direction between a lowered position with the terminal edge distal to the distal edge of the frame and a raised position with the terminal edge proximal to the flange of the frame, and when the inner sleeve is in the raised position is reciprocable between a forward position substantially aligned with the access opening blocking access to the electronics unit from the bottom surface of the building member to a rear position exposing at least a portion of the access opening allowing access to the electronics unit from the bottom surface of the building member.

13. The lighting assembly of claim 12, wherein the access opening has a diameter of at least approximately 150 mm.

14. The lighting assembly of claim 12, wherein the electronics unit is positioned a perpendicular distance $D_x$ from a line perpendicular to the lower edge of the outer frame at a position that is closest to the electronics unit, and a perpendicular distance Dy from the bottom surface of the building member, and the access opening has a diameter D that is no less than the sum of $75+D_x+D_y$ measured in millimeters.

15. The lighting assembly of claim 12, wherein the slot in the first bracket and the slot in the second bracket both have a substantially inverted U-shape.

16. The lighting assembly of claim 12, wherein the slot in the first bracket and the slot in the second bracket both have a substantially inverted L-shape.

17. The lighting assembly of claim 12, wherein the slots in the brackets each have a substantially vertical section and a substantially horizontal section.

18. The lighting assembly of claim 12, comprising a removable trim cap attached to the inner sleeve proximate the terminal edge.

19. The lighting assembly of claim 12, wherein the inner sleeve is engaged in a sliding relationship with each of the brackets via a bolt mating within the slot of each brackets.

20. The lighting assembly of claim 19, wherein the respective bolts extend into the inner sleeve and carry a nut for tightening to the respective brackets.

* * * * *